United States Patent [19]

Storck et al.

[11] 4,082,410

[45] Apr. 4, 1978

[54] ELECTRICAL CONNECTORS AND CONTACT ASSEMBLIES THEREFOR

[75] Inventors: Glenn E. Storck, Long Valley; Andrew A. Kominiak, Flanders, both of N.J.

[73] Assignee: Amerace Corporation, New York, N.Y.

[21] Appl. No.: 683,881

[22] Filed: May 6, 1976

[51] Int. Cl.[2] ..... H01R 13/06

[52] U.S. Cl. ..... 339/252 R; 339/95 A

[58] Field of Search ..... 339/95, 252, 255, 256, 339/258

[56] References Cited

U.S. PATENT DOCUMENTS

| | | | |
|---|---|---|---|
| 2,280,728 | 4/1942 | Streib | 339/256 R |

FOREIGN PATENT DOCUMENTS

| | | | |
|---|---|---|---|
| 2,138,989 | 1/1973 | Germany | 339/255 R |
| 22,476 | 12/1961 | Germany | 339/256 R |
| 704,450 | 3/1941 | Germany | 339/252 P |
| 2,035,681 | 1/1972 | Germany | 339/256 RT |

*Primary Examiner*—Joseph H. McGlynn
*Attorney, Agent, or Firm*—S. Michael Bender

[57] ABSTRACT

An electrical connector includes a contact assembly having a cylindrical contact element and a terminal member defining a cylindrical contact element support surface and contact element retention surfaces juxtaposed with the support surface with passages opening into the terminal member and extending through the retention surfaces. Axially facing ends of the retention surfaces have spacing therebetween less than the axial extent of the contact element for retaining the same and axially distal ends of the passages have spacing therebetween exceeding the contact element axial extent to facilitate non-deforming contact element insertion in the terminal member.

10 Claims, 12 Drawing Figures

FIG.1
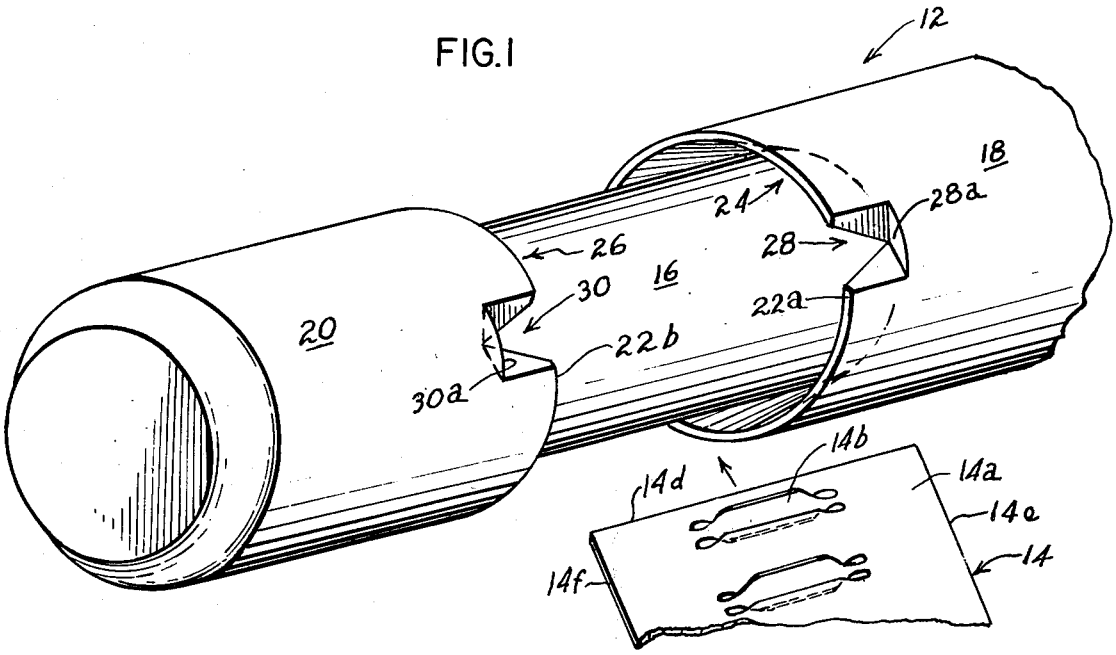
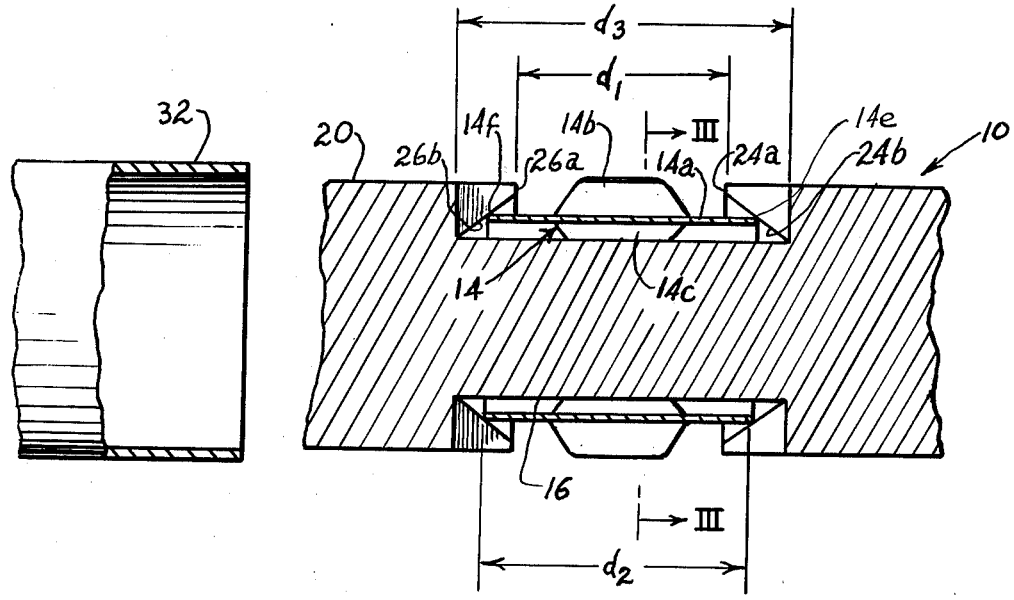
FIG.2

ELECTRICAL CONNECTORS AND CONTACT ASSEMBLIES THEREFOR

FIELD OF THE INVENTION

This invention relates generally to electrical connectors and contact assemblies thereof and more particularly to electrical contact assemblies having so-called louvered contact elements.

BACKGROUND OF THE INVENTION

Louvered contact elements comprise elongate electrically conductive strip members having transverse expanses which are bent or twisted with respect to the strip member so as to provide opposed sets of contact fingers extending outwardly of the strip member. In providing a connector, such contact element is assembled with one set of its contact fingers in engagement with one terminal member and this assembly mates with another terminal member which is engaged by the other contact finger set. Known connectors employ louvered contact elements in flat configuration in conjunction with flat terminal members and in cylindrical configuration in which case the terminal members are of plug and socket configuration, as shown, for example, in Crabbs U.S. Pat. No. 2,217,473 and Neidecker U.S. Pat. No. 3,453,587.

Connectors of louvered contact element type have the capability of maximizing current flow for a given voltage drop between a pair of terminal members by virtue of their increased surface contact area over that attainable by direct mutual engagement of such terminal members. The realization of maximized current flow is dependent, in one aspect, on providing secure retention of the louvered contact element in or on its associated supporting terminal member while at the same time maintaining the intended surface engagement therebetween as called for by design specifications.

Various contact retention measures are presently known. In the above-referenced Crabbs patent, a plug and socket connector arrangement (FIG. 7) embodies a louvered contact element which is retained through a self-biasing arrangement, i.e., the louvered contact element strip member is formed into a cylinder and is nested by its own resilience in an axially extending cylindrical recess formed in the socket with the outwardly extending set of the contact element fingers engaging the recess wall. The plug is engaged by the interiorly extending finger set on insertion in the socket. A like self-biasing arrangement is shown in the above-referenced Neidecker patent. This latter patent also provides for assembly of the contact element in encircling relation to the plug (FIGS. 8 and 9) wherein the strip member is provided with crenellated edges which are bent over axially spaced shoulders of the plug, the plug surface between the shoulders being engaged by the interiorly extending finger set. A variation of this last-discussed technique is shown in Niederer U.S. Pat. No. 3,751,619.

The employment of self-bias for contact element retention in socket terminal members becomes less reliable as socket diameters increase and self-biasing retention forces decrease, thereby increasing the likelihood of unintended contact element removal upon plug manipulation.

Commonly-assigned copending application Ser. No. 503,783 of Johnson et al., filed on Sept. 6, 1974 discloses, in one of its aspects, that louvered contact element self-biased retention in socket terminal members is enhanced by providing respectively dissimilar longitudinal extents for the contact element finger sets. With the shorter length finger set extending to the socket recess wall, the contact element is seated more deeply in the socket and is accordingly better retained by self-bias. Such arrangement also provides lessened spring rate for the longer contact finger set engaging the plug thereby reducing manufacturing tolerances for the connector parts.

In addition to the foregoing arrangements wherein louvered contact elements are retained by self-bias in sockets or by having bent edges engaging plugs, the art has looked to embodiments wherein the contact elements may be positively retained either on the plug or socket terminal members by means apart from the contact elements. Thus, in a present commercial practice, cylindrically formed contact elements are seated on plugs and retention rings are snapped onto the sides of the strip member to force the same onto the plug surface. Further, in literature distributed by Multilam Corporation, Los Altos, Ca. and dated July 12, 1973, arrangements are depicted (pages 2, 6 and 7) wherein slots are cut in plugs or sockets to provide an axially extending contact element support surface with circumferentially continuous contact element retention surfaces located at the ends of the support surface and extending at acute angles to respective ends thereof which are axially spaced by a distance less than the axial extent of the contact element. Accordingly, the ends of the contact element engage the retention surfaces interiorly of such retention surface ends.

The positive contact element retention inherent in such commercial and literature arrangements is believed to suffer certain disadvantages. For example, contact element replacement is more difficult than in the self-biased and crenellated edge embodiments noted heretofore. In the commercial arrangement, snap rings need be removed. In the literature arrangement, it would appear that one need pry the contact element free of the circumferentially continuous retention surfaces. Further, in the case of each of these arrangements, it is considered difficult to achieve the aforesaid design specification surface engagement between the louvered contact element and its supporting terminal member due to inherent variations in retention forces imposed by the retention elements themselves and/or the person assembling or reassembling the connector. As will be appreciated, variation in snap ring force displacing the web sides of the strip member toward the surface engaged by the contact fingers can adversely affect intended contact finger surface engagement. In assembling a contact element with such axially slotted terminal member having circumferentially continuous retention surfaces as in the literature arrangement, the contact element is formed into a cylinder and need apparently be manipulated, i.e., its strip member radially bowed, to arrange for entry of its axial ends interiorly of the retention surface ends. Such deformation of the contact element evidently can modify intended contact finger surface engagement.

Further patents which serve as background material for the subject invention in describing connectors subject to the foregoing operational shortcomings include Deal U.S. Pat. Nos. 3,861,595 and 3,861,776, Burke U.S. Pat. No. 1,901,894, Streib U.S. Pat. No. 2,280,728 and German Pat. No. 1,106,390.

SUMMARY OF THE INVENTION

It is an object of the present invention to provide improved electrical connectors and louvered contact assemblies therefor.

It is a more specific object of the invention to provide for enhanced retention of louvered contact elements in a terminal member while insuring against any departure from intended contact surface engagement therewith.

It is a further object of this invention to provide for convenient and improved assembly of electrical connectors having louvered contact elements.

In attaining the foregoing and other objects and features, the invention provides an electrical connector having a contact assembly including a contact element having an elongate flexible strip member shaped into a cylinder of first axial dimension and a terminal member defining a cylindrical contact element support surface coaxial with the contact element, retention surfaces juxtaposed with the support surface and having portions engaging the contact element and facing ends axially spaced from one another by a distance less than such first axial dimension and passages opening into the terminal member, the spacing between respective axially distal ends of the passage exceeding such first axial dimension. In making the contact assembly, one longitudinal end of the strip member is inserted into such passages interiorly of the retention surfaces and the remainder of the strip member is then advanced linewise until the entirety of the strip member is interiorly of the retention surfaces. For contact element replacement, the assembly procedure may be reversed with a longitudinal end of the strip member being withdrawn through the passages exteriorly of the contact retention surfaces. The invention may be practiced with a plug or socket terminal member receiving and retaining the contact element.

The foregoing and other objects and features of the invention will be evident from the following detailed description of preferred embodiments and practices and from the drawings wherein like reference numerals identify like parts throughout.

DESCRIPTION OF THE DRAWINGS

FIG. 1 is a perspective view showing a plug terminal member in accordance with the invention and a louvered contact element for use therewith.

FIG. 2 is a sectional elevation of an assembly of the terminal member and contact element of FIG. 1, shown with a matable terminal member disconnected therefrom.

DESCRIPTION OF THE PREFERRED EMBODIMENTS

Figure 3B:
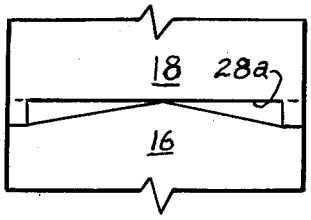
FIG. 3(b) is a partial plan view of the FIG. 3(a) showing.

Referring to FIGS. 1 and 2, contact assembly 10 includes a male terminal member or plug 12 and a contact element or band 14 of above-mentioned louvered type, having a strip member or web **14*a* with contact finger sets 14*b* and 14*c* extending outwardly from opposite surfaces thereof. Plug 12 has a cylindrical contact element support surface 16 defined by a reduced diameter central portion thereof and further includes portions having cylindrical surfaces 18 and 20 of diameters different from that of support surface 16 and overlying respective axial ends of support surface 16, all preferably being integrally formed. Surfaces 18 and 20 have respective facing ends 22*a* and 22*b* and contact element retention surfaces 24 and 26 are juxtaposed therewith and extend inwardly from ends 22*a* and 22*b* to the contact element support surface. As is better seen in FIG. 2, surface 24 preferably includes one surface expanse 24*a* extending generally transversely of surface 16 and another surface expanse 24*b* preferably extending at an acute angle to surface 16. Surface 26 likewise includes a surface expanse 26*a* extending generally transversely of surface 16 and another surface expanse 26*b* preferably extending at an acute angle to surface 16**.

As is seen from the dimensional showings in FIG. 2, ends **22*a* and 22*b* of surfaces 18 and 20 are spaced axially along plug 12 by a distance $d_1$. Strip member 14*a* of contact element 14 has an axial extent $d_2$ when contact element 14 is cylindrically formed in manner discussed below with contact finger set 14*c* engaging surface 16. Surface 16 is itself of axial extent $d_3$. With $d_3$ exceeding $d_2$ and $d_2$ in turn exceeding $d_1$, contact element 14 is retained with plug 12 by engagement of side margins 14*e* and 14*f* of strip member 14*a* with retention surface expanses 24*b* and 26*b*, as shown in FIG. 2**.

In accordance with the subject invention, surface expanses **24*b* and 26*b*, while generally circumferentially continuous, define discontinuities facilitating insertion of contact element 14 interiorly of the contact element retention surfaces without need for subjecting the strip member to radial bowing or other deformation. Such retention surface discontinuities preferably comprise entry passages 28 and 30 (FIG. 1), respective axially distal ends 28*a* and 30*a* of the passages being spaced axially by distance $d_3$ (FIG. 2) or other distance suitably exceeding $d_2$. The respective proximate ends of passages 28 and 30 are contiguous with ends 22*a* and 22*b* of surfaces 18 and 20**.

Figure 3A:
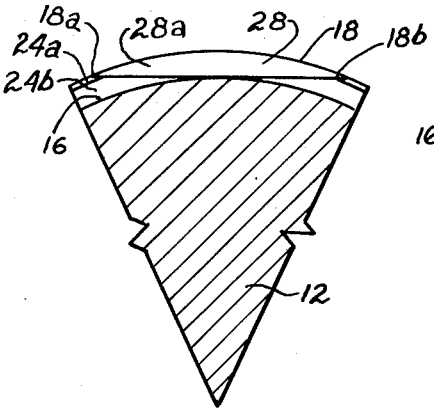
FIG. 3(a) is a partial sectional view of the terminal member of FIG. 2 as seen from plane III—III of FIG. 2.

Considering passage 28, the same opens into plug 12 through surface 18 and extends through retention surface expanses **24*a* and 24*b*. To form this passage, a flat cut is made as in FIGS. 3(a) and 3(b) between spaced locations 18*a* and 18*b* axially through the angled retention surface into the rightward enlarged diameter portion of plug 12. The cut is made tangentially to surface 16 and to the rightward end of surface 16, i.e., to thus formed passage distal surface 28*a*. Passage 30** is formed in the same manner.

Figure 4B:
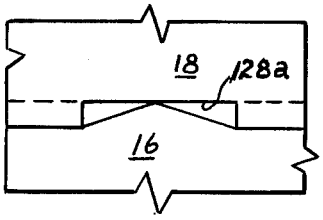
FIGS. 4(b), 5(b), 6(b) and 7(b) are respective plan views of the showings in FIGS. 4(a) through 7(a).
Figure 5B:
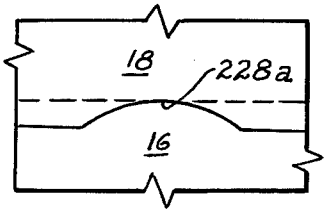
Figure 4A:
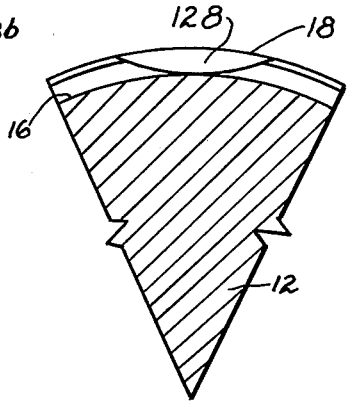
FIGS. 4(a), 5(a), 6(a) and 7(a) are partial sectional views as in FIG. 3(a) of further embodiments of plug terminal members in accordance with the invention.
Figure 5A:
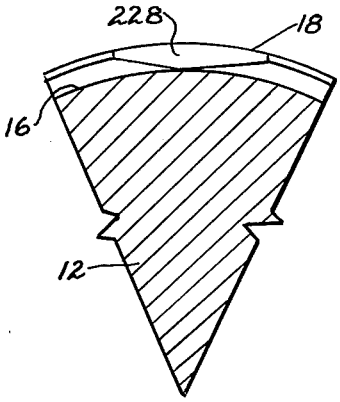

Referring to FIGS. 4(a) and 4(b), passage 128 is formed by making a radial cut, moving the cutting tool axially through the angled retention surface of plug 12 to thus formed passage distal end **128*a*. In FIGS. 5(a) and 5(b), passage 228 is formed by making a radial cut, moving the cutting tool perpendicularly to plug 12 from surface 18 to surface 16 along thus formed distal end 228*a***.

Figure 6B:
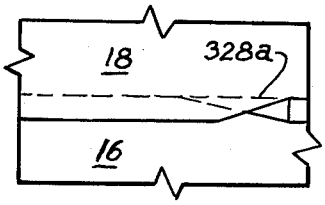
Figure 7B:
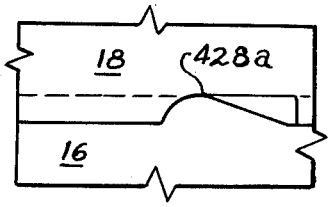
Figure 6A:
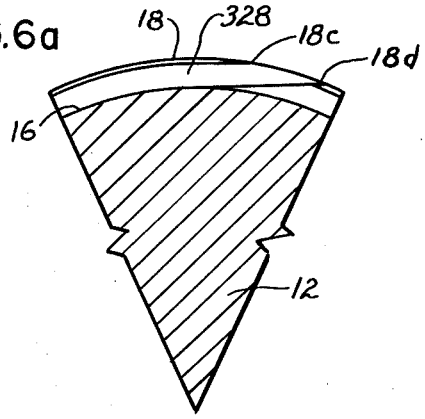
Figure 7A:
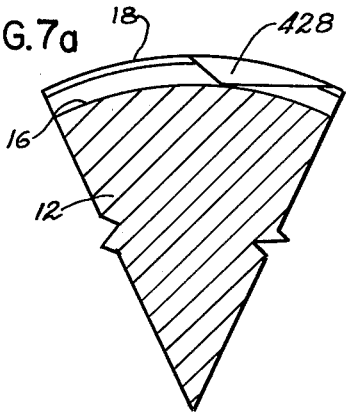

Referring to FIGS. 6(a) and 6(b), passage 328 is formed by inserting a flat cutting tool radially interiorly of surface expanse **24*a* and displacing the tool generally tangentially of surface 16 to the axial depth of thus formed distal end 328*a* to cut through surface 18 at locations 18*c* and 18*d*. In FIG. 7(a) and 7(b), passage 428 is formed by moving a round cutter end mill perpendicularly to plug 12 from surface 18 to surface 16 along thus formed distal end 428***a*.

With plug 12 formed with contact element support surface 16, juxtaposed contact element retention surfaces and passages as discussed above, longitudinal end 14*d* (FIG. 1) of strip member 14*a* is inserted into the passages such that side margins 14*e* and 14*f* are respectively spacedly adjacent passage distal ends 28*a* and 30*a*. The remainder of the strip member is then advanced linewise of its own longitudinal extent and circumferentially counterclockwise of surface 16, with contact fingers 14*c* engaging such surface 16, until the strip member is fully cylindrical and disposed in engagement with retention surface expanses 24*b* and 26*b*. To facilitate assembly, contact element 14 is preferably shaped cylindrically prior to its insertion in the passages. The contact assembly may now be engaged for electrical circuit interconnection by a mating terminal member, such as socket terminal member 32 of FIG. 2.

The opposed finger sets, 14*b* and 14*c*, of contact element 14 are preferably of dissimilar longitudinal extent, as in the above-mentioned copending Johnson et al. patent application. As is seen in FIG. 2, with set 14*b* of greater length than set 14*c*, web 14*a* may accordingly be retained more deeply in engagement with plug 12 than in the case of the customary symmetrical louvered contact.

While the invention has been discussed in the forming of a plug terminal member, a socket terminal member may constitute the terminal member defining the contact element support surface, the contact element retention surfaces and the passages therethrough. In this embodiment, a socket defines an axially extending recess which is bounded radially outwardly by such cylindrical contact element support surface. The support surface overlies, i.e., is radially outward of and extends axially over, further cylindrical surfaces concentric therewith and of diverse diameter therefrom. These further surfaces have ends axially spaced by a distance less than the contact element axial extent and the retention surfaces extend therefrom in juxtaposition with the support surface. Passages are then formed opening radially within the socket and extending radially outwardly through such further surfaces and the retention surfaces with distal passages ends axially spaced by a distance exceeding such contact element axial extent. The contact element is inserted into the socket terminal member by being cylindrically formed and so inserted into the socket with a longitudinal end of the strip member thereof being inserted into the passage and the remainder fed interiorly of the retention surfaces as above discussed for plug 12.

In the foregoing arrangements, terminal members 12 and 32 are comprised of electrically conductive material, such as copper, brass or aluminum and contact element 14 is of electrically conductive material and may be comprised, for example, of a beryllium copper alloy. Other material choices and variations in the foregoing embodiments and practices evident to those skilled in the art may be introduced without departing from the subject invention. Accordingly, the particularly disclosed preferred embodiments are intended in an illustrative and not in a limiting sense. The true spirit and scope of the invention is set forth in the appended claims.

What is claimed is:

1. A contact assembly comprising:

a. a cylindrical contact element in the form of an elongate strip member having opposed surfaces extending between opposed side margins thereof and first and second contact fingers extending respectively outwardly of said opposed strip member surfaces, said strip member having an axial extent measured between the opposed side margins thereof, and b. a terminal member defining a cylindrical contact element support surface of axial extent parallel to the axial extent of said contact element, said axial extent of said contact surface exceeding said axial extent of said contact element, said terminal member having a pair of circumferentially extending, contact element retention surfaces juxtaposed with said support surface respectively, said surfaces having respective axially facing ends spaced apart by a distance less than said axial extent of said contact element, and at least a pair of axially spaced and aligned passages extending respectively through said circumferentially extending retention surfaces, the spacing between axially distal ends of said passages exceeding said axial extent of said contact element, and wherein said passages provide entry means through which said elongate strip member may be inserted into engagement between said contact element retention surfaces and said support surface without causing distortion of said strip member and with said first contact fingers engaging said support surface and said opposed strip member side margins engaging said retention surfaces.

2. The contact assembly claimed in claim 1 wherein said retention surfaces each include a surface expanse disposed at an acute angle to said support surface.

3. The contact assembly claimed in claim 1 and a further terminal member engaging said contact element.

4. The contact assembly claimed in claim 1 wherein said first contact fingers are of length outwardly of said strip member less than the length of said second contact fingers outwardly of said strip member.

5. The contact assembly claimed in claim 4 wherein said strip member encircles said support surface.

6. An electrical contact assembly comprising:

a. A contact element having a flexible strip member shaped into a cylinder of first axial dimension, wherein said contact element comprises a strip member having opposed surfaces extending between opposed side margins thereof and first and second contact fingers extending respectively outwardly of said opposed strip member surfaces, said first contact fingers adapted to engage a support surface on a terminal member, said strip member side margins adapted to engage retention surfaces on said terminal member; and b. a terminal member defining 1. a cylindrical contact element support surface of axial extent between opposed ends thereof exceeding said first axial dimension,
2. first and second cylindrical surfaces concentric with said support surface and of diameters different from the diameter of said support surface and having respective axially facing ends spaced from one another by a distance less than said first axial dimension,
3. first and second contact element retention surfaces extending from said first and second cylindrical surfaces respectively to said opposed support surface ends, and 4. first and second axially spaced and aligned passages extending respectively through said first cylindrical surface and said first retention surface and through said second cylindrical surface and said second retention surface, the spacing between axially distal ends of said passages exceeding said first axial dimension wherein said passages provide entry means through which said strip member may be inserted into engagement between said contact element retention surfaces and said support surface without causing distortion of said strip member and with said first contact fingers engaging said support surface and said opposed strip member side margins engaging said retention surfaces.

7. The contact assembly claimed in claim 6 wherein said retention surfaces each include a surface expanse disposed at an acute angle to said support surface.

8. The contact assembly claimed in claim 6 and a further terminal member engaging said contact element.

9. The contact assembly claimed in claim 6 wherein said first contact fingers are of length outwardly of said strip member less than the length of said second contact fingers outwardly of said strip member.

10. The contact assembly claimed in claim 9 wherein said strip member encircles said support surface.

* * * * *

UNITED STATES PATENT AND TRADEMARK OFFICE

CERTIFICATE OF CORRECTION

PATENT NO. : 4,082,410

DATED : April 4, 1978

INVENTOR(S) : Glenn E. Storck and Andrew A. Kominiak

It is certified that error appears in the above-identified patent and that said Letters Patent are hereby corrected as shown below:

Column 1, line 26, change "2,217,473" to --2,217,433--.

Signed and Sealed this

*Fifteenth* Day of *July 1980*

[SEAL]

*Attest:*

SIDNEY A. DIAMOND

*Attesting Officer*

*Commissioner of Patents and Trademarks*